United States Patent [19]

Ou-Yang

[11] Patent Number: 4,579,240

[45] Date of Patent: Apr. 1, 1986

[54] TAMPER INDICATING CAP ASSEMBLY

[75] Inventor: David T. Ou-Yang, Cottage Grove, Minn.

[73] Assignee: Minnesota Mining and Manufacturing Company, St. Paul, Minn.

[21] Appl. No.: 669,882

[22] Filed: Nov. 9, 1984

[51] Int. Cl.[4] ..... B65D 51/00

[52] U.S. Cl. ..... 215/230; 215/232

[58] Field of Search ..... 215/230, 232; 220/359

[56] References Cited

U.S. PATENT DOCUMENTS

| | | | |
|---|---|---|---|
| 2,168,594 | 8/1939 | Von Till | 215/230 |
| 2,939,597 | 6/1960 | Greene | 215/230 |
| 4,171,084 | 10/1979 | Smith | 215/232 X |
| 4,501,371 | 2/1985 | Smalley | 215/232 |

*Primary Examiner*—Donald F. Norton

*Attorney, Agent, or Firm*—Donald M. Sell; James A. Smith; David L. Weinstein

[57] ABSTRACT

A tamper indicating cover has at least a portion of the top being translucent or transparent and a seal adhered to the cover and container in such a manner that relative rotation between the cover and container ruptures the seal and provides a visible indication that the container has been opened.

12 Claims, 5 Drawing Figures

TAMPER INDICATING CAP ASSEMBLY

BACKGROUND OF THE INVENTION

1. Field of the Invention

This invention relates to an improvement in liners for bottle or other container caps capable of providing a visual indication, at the point of purchase, or at least before use, as to whether the container has been previously opened.

2. Description of the Prior Art

This invention relates to an improvement in a container seal which fits beneath the cap to afford the consumer an opportunity to readily determine whether or not the cap has been previously opened or tampered with since the container left the manufacturer or packaging company. The need for barriers within a cap to seal the container has become required, but the cap must typically be removed at the point of purchase to determine in fact whether or not any tampering was undertaken relative to the inner seal. The present invention provides a tamper-indicating inner seal for caps having at least a portion of the top thereof being translucent, such that one can readily tell whether or not the cap has been tampered with at the point of purchase.

The need for prevention of removal of a container seal and replacing same without detection has existed for some time. One prior patent relating to a rupturable container closure is disclosed in U.S. Pat. No. 2,131,774. There is disclosed therein a cap which is used to force a plate against a liner or gasket to seal the top of a bottle. Between the plate and the cap is a rupturable disk of fibrous or other suitable rupturable material having impressed thereon a safety design of a type intended to make the duplication or counterfeit of the disk as difficult as possible. It is desirable to bond the disk to the plate by use of a suitable adhesive or cement. The cap, however, is provided with prongs, which, after the cap is in place, are forced downward to penetrate the rupturable disk in areas above a groove formed in the metal plate. When opening the container, it is merely necessary for the consumer to impart a reverse turning movement to the closure. During the first portion of this movement, the metal shell will turn independently of the packing liner or gasket, the plate and the rupturable disk, and the prongs will move along the groove and tear the material of the disk, thereby forming jagged and irregular therein. After the prongs have once been placed through the disk, it is taught to be extremely difficult to remove the cap in a manner which could avoid detection.

The invention of the present application provides a rupturing and tearing of an inner seal upon rotation of the cap in relationship to the container in somewhat the same manner, but, adhesives or heat sealable films are used to adhere the rupturable liner to the inside of the cap and an adhesive is used to bond the rupturable disk to a laminate forming the seal of the container such that the relative movement causes the tearing and a very visible indication of closure tampering.

The present invention has the advantage of being formed for use with conventional cap lining equipment and conventional induction sealing equipment capable of sealing existing cap liner materials to the container at the time they are filled.

SUMMARY OF THE INVENTION

The present invention provides a tamper indicating cover member suitable for use on a wide variety of containers and comprises a cap having at least a portion of the top thereof being translucent, i.e., translucent or transparent, and an inner seal for sealing to the container after same has been filled. A deposit of adhesive or a heat sealable film adhere the cap, inner seal and container together in such a manner that relative rotation between the cap and the container ruptures the inner seal in a manner to be visible through the cap. The inner seal comprises a membrane of rupturable material adapted to be placed within the side walls and sealed to the inner surface of the top of the cap, with a second membrane of seal material adapted to be sealed to the upper surface of the neck of a container. The cap inner seal material may be punched from a web to form a disk shaped to be placed in a cap, utilizing conventional machinery for inserting cap liners into caps. After the container is filled, the cap and inner seal will be placed on the container. Suitable means, such as induction heating, can be utilized to seal the inner seal to the container about the opening thereof, and also to releasably bond the rupturable disk to the cap. By this technique, the rupturable disk, cap and container will be adhered together in a manner such that the rupturable disk will tear as the cap is rotated relative to the container.

This same rupturing effect will occur utilizing a translucent polymeric cap capable of being snapped on and off of a rib or shoulder formed around the open end of a container, for example as the cap may be turned to align or match an arrow thereon and an arrow on the container, such as with a child-proof cap.

The rupturable disk is preferably formed from a thin layer of a metal foil, such as aluminum, which is coated with a heat sealable layer such a polyethylene, polypropylene, or an adhesive.

The rupturable disk and the paper or film barrier layer of the liner are preferably printed or coated with different colored materials which will be readily exposed in the ruptured areas of the rupturable disk to indicate that the container has been opened.

BRIEF DESCRIPTION OF THE DRAWINGS

The invention will be further described with reference to the accompanying drawing wherein.

DESCRIPTION OF THE PREFERRED EMBODIMENTS

Figure 1:
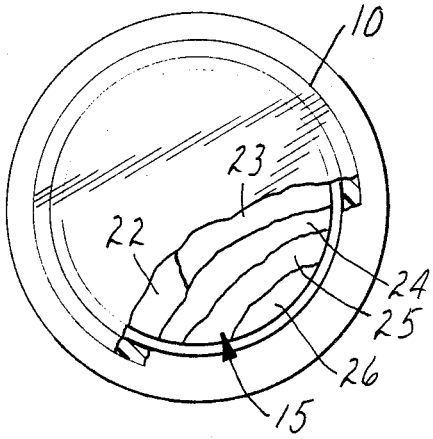
FIG. 1 is a top view of a cap and liner with portions thereof broken away to illustrate interior layers.

The present invention provides an improved cap and liner which when sealed to a container with the cap attached will provide a readily detectable tamper-indicating closure for the container. As illustrated in the attached drawings, where similar numerals on the various figures illustrate identical parts, a cap 10 is formed of a translucent or transparent polymer, having a top and connecting side walls with internal threads 11 to mate with threads 12 provided on the outer surface about the neck and opening of container 13. Cap 10 is formed of polyolefin or other suitable polymeric material, and could be a snap fitted cap to mate with a rib formed about the opening of the container, such as conventional child-proof caps having an arrow thereon which is rotated to match an arrow or location on the container, at which location the cap may be snapped off. The threaded cap is chosen for purposes of illustration. Furthermore, at least a portion of the cap surface should be transparent for reasons hereafter described.

A cap liner generally designated by the reference numeral 15 is typically placed inside the cap by the cap manufacturer. Caps are supplied to the packager with the liner already placed in the cap. Cap liner 15 comprises a membrane or disk 16 of rupturable material preferably coated with an adhesive or a heat sealable material or both, designated as 22. Many cap manufacturers place a small amount of adhesive, shown as 21, inside the cap, but such is only optional if coating 22 is present. On the opposite side of disk 16 from adhesive or heat sealable layer 22 is a coating of wax, a derivative thereof, or a low molecular weight and low tack adhesive layer 24. Laminated to wax layer 24 is a second membrane, preferably formed of paper or film, which is preferably less than about 10 mils in thickness, designated by numeral 25. Coated onto second membrane 25 is an adhesive or heat sealable film, such as polyethylene, or a combination of both, designated as layer 26, and the materials of layer 26 can be the same or different from those of top layer 22.

Figure 2:
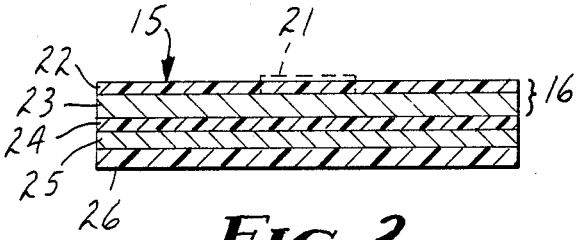
FIG. 2 is a cross sectional view illustrating the construction of the web of liner material from which the cap liners are die cut.

As illustrated in FIG. 2, the web from which cap liner 15 is die cut comprises a layer 23 of metal foil, such as dead soft aluminum, which typically may be 0.001 inch (1.00 mil) in thickness, although foils up to about 0.002 inch (2.0 mils) have been utilized with success. Layer 23 preferably has a top coating 22 of a heat sealable material, such as polyethylene or polypropylene, or may be an adhesive, whereupon layer 23 and coating 22 define rupturable disk 16. In addition, printed messages, or a color, other than the normal silver finish of the foil, may also be applied. Wax, a derivative thereof or a low molecular weight and low tack adhesive is applied over rupturable disk 16 as layer 24. Examples thereof include Petrolite's Victory Amber Wax, Witco Chemical's Multiwax W-835, etc. Attached to metal foil layer 23 by the wax or low tack adhesive coating 24 is a second membrane 25 which is preferably less than about 10 mils in thickness. Examples of paper include Rhinelander Paper Company's 35 lb. bleached vellum or pouch paper. Film examples include polypropylene, polyester, etc. Coated over second membrane 25 is an adhesive or a heat sealable film 26, such as polyethylene, or both, and this material may or may not be the same as that used for preferred layer 22. A preferred adhesive is that disclosed in U.S. application Ser. No. 578,652, filed 2/9/84 incorporated herein by reference.

Second membrane 25 can also contain printing or a color thereon which is different than that applied to rupturable layer 23.

Figure 4:
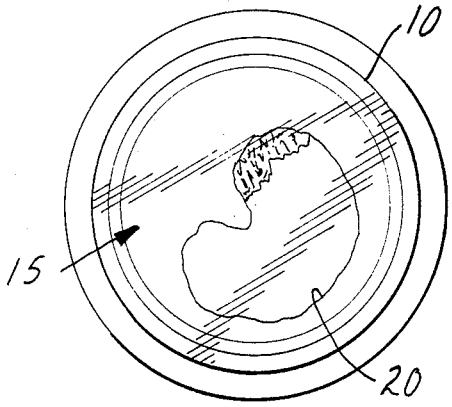
FIG. 4 is a diagramatic top view of the cap after it has been opened.
Figure 3:
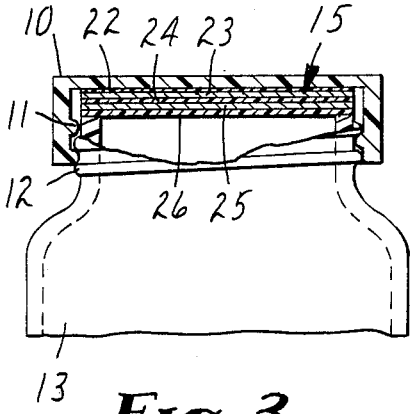
FIG. 3 is a vertical sectional view of a cap and liner constructed in accordance with the present invention sealed to a container.
Figure 5:
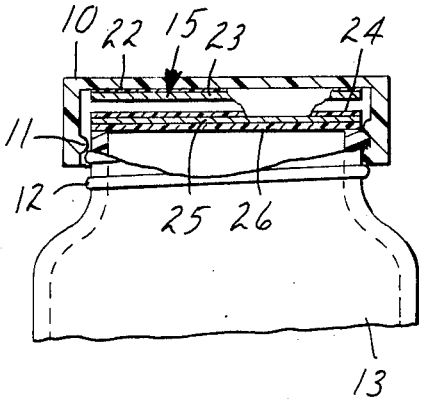
FIG. 5 is a vertical sectional view of the cap as it is opened.

As illustrated in FIGS. 4 and 5, rotation of cap 10 in an unwinding direction, with the disk 16 in place causes disk 16 to rupture or tear on opening as illustrated at 20. Continued relative rotation of the cap and container will result in disk 16 being torn and separated from second membrane 25 as illustrated in FIG. 5, thereby providing through the transparent or translucent cap 10 a clear visual indication that the cap has previously been opened.

The disk 16 may be color coded or printed with suitable ink to bear a desired message or a manufacturer's logo. Second membrane 25 can also be colored or printed with contrasting colors to those of disk 16 to thus expose the contrasting colors through the torn membrane, or to expose the message "OPENED", for example, which is a clear indication of relative cap movement.

As the inner seal is passed through conventional induction heating fields, metal foil layer 23 heats up instantaneously, thus causing a melting of wax or adhesive layer 24, thus causing either partial detackification or absorption thereof by or mixing with second membrane 25. The adhesion between foil layer 23 and second membrane 25 is thus sharply decreased, especially around the highly pressurized edge area of the inner seal.

At the same time, optional adhesive or heat sealable layer 22 and adhesive or heat sealable layer 26 are melted and thus respectively bonded to the inside of the cap and to the lip of the container.

When cap 10 is opened, metallic foil layer 23 will be torn by unscrewing cap 10, or by removal of the cap if a snap cap construction is utilized. A large portion of second membrane 25, with different colors and/or printing from the metallic foil layer 23 will thus be revealed, and provide a warning that the container has been tampered with.

After the cap is opened, the remaining layer or layers, such as adhesive or wax layer 24, second membrane 25 and heat sealable film or adhesive layer 26 can serve as a secondary tamper indicator for the consumer, and these remaining layers can be easily broken or removed with the fingers for ease of entry to the container.

As the cap 10 passes through the induction heater, and metallic foil layer 23 is heated, a melting of wax or adhesive layer 24 occurs. The adhesion between metallic layer 23 and second membrane 25 is decreased sharply at the pressurized edge area, but is substantially maintained at the central portion of the inner seal. Thus, as cap 10 is rotated to open same, this bond at the center of the inner seal between foil 23 and second membrane 25 causes a rupture or tearing of the metallic layer 23 from second membrane 25, providing the benefits described above.

In the above constructions, examples of heat sealable films include ethylene vinyl acetate, polyethylene, polyvinyl chloride, polyethylene terephthalate, polystyrene and polypropylene. The specific choice depends upon the type of containers to be sealed.

Commercially available waxes for use herein should typicaly have a melting point of less than about 200° F., and preferably have a penetration, as determined pursuant ASTM D1321, of between about 15 and about 45. Microcrystalline waxes are preferred.

Having disclosed the invention with reference to the preferred embodiment, it is understood that modifications that can be made without departing from the spirit or scope of the invention as defined in the appended claims.

What is claimed is:

1. Sheet material for providing a tamper-indicating inner seal for a translucent cover member attachable to a container comprising a rupturable membrane, a layer of a heat flowable composition selected from the group consisting of wax, derivatives thereof and low-tack adhesives coated onto one surface of said rupturable membrane; a second membrane attached to said rupturable membrane by means of said layer of heat flowable composition; and a layer of adhesive or heat activatable sealing composition coated onto the surface of said second membrane opposite the surface of said second membrane bearing said layer of heat flowable composition.

2. The sheet material of claim 1 wherein said rupturable membrane further contains a heat activatable sealing composition on the surface of said rupturable membrane opposite from said heat flowable composition.

3. The sheet material of claim 1 wherein said rupturable membrane comprises aluminum.

4. The sheet material of claim 1 wherein said second membrane comprises paper or a polymeric film.

5. A tamper-indicating cap for use in sealing an opening in a container, comprising:

an at least partially translucent cap body having a top and connecting side walls;

a rupturable membrane placed in and visible through said top;

a layer of heat flowable composition selected from the group consisting of wax, derivatives thereof, and low-tack adhesives coated onto said rupturable membrane;

a second membrane attached to said rupturable membrane by means of said layer of heat flowable composition;

and a layer of adhesive or heat activatable sealing composition coated onto the surface of said second membrane opposite the surface of said second membrane bearing said heat flowable composition for attachment of said second membrane to a container about its opening, so that after said cap is affixed to a container, relative movement between said cap and said container will rupture said rupturable membrane.

6. The tamper-indicating cap of claim 5 wherein said rupturable membrane further contains a heat activatable sealing composition on the surface of said rupturable membrane opposite from said heat flowable composition.

7. The tamper-indicating cap of claim 5 wherein said rupturable membrane comprises aluminum.

8. The tamper-indicating cap of claim 5 wherein said second membrane comprises paper or a polymeric film.

9. A container having a tamper-indicating translucent cover member removably mounted over an opening in said container, and comprising:

a rupturable membrane fixedly attached to said cover member and visible through said cover member, a deposit of a heat-flowable composition capable of contacting securely at least a portion of said rupturable membrane to a second membrane upon application of heat thereto, said second membrane being fixedly attached to said container such that relative movement between said container and cover member causes the rupturing of said rupturable membrane.

10. The container and cover member in accordance with claim 9 wherein said second membrane has a visual appearance on the surface contacted by said heat flowable deposit which is different from said rupturable membrane surface.

11. The container and cover member according to claim 9 wherein a printed message appears on said rupturable membrane which is impaired upon relative movement of said cover member and said container.

12. The container and cover member according to claim 9 wherein said second membrane has a color on the surface adjacent the rupturable membrane which is readily visibly distinct from the color of the rupturable membrane visible through said cover.

* * * * *

UNITED STATES PATENT AND TRADEMARK OFFICE

CERTIFICATE OF CORRECTION

PATENT NO. : 4,579,240

DATED : April 1, 1986

INVENTOR(S) : David T. Ou-Yang

It is certified that error appears in the above-identified patent and that said Letters Patent is hereby corrected as shown below:

Col. 1, line 50, "irregular therein" should read --irregular tears therein--.

Col. 4, line 56, "typicaly" should read --typically--.

Signed and Sealed this

*Fifth* Day of *August 1986*

[SEAL]

*Attest:*

DONALD J. QUIGG

*Attesting Officer*

*Commissioner of Patents and Trademarks*